United States Patent [19]

Pierce

[11] Patent Number: 4,621,848

[45] Date of Patent: Nov. 11, 1986

[54] PORTABLE FOOT OPERATED DOOR OPENER

[76] Inventor: Robert E. Pierce, Box 134, Pittsburg, N.H. 03592

[21] Appl. No.: 699,040

[22] Filed: Feb. 7, 1985

[51] Int. Cl.[4] ..... E05C 1/16; E05C 13/06

[52] U.S. Cl. ..... 292/336.3; 292/DIG. 25; 292/174; 292/166

[58] Field of Search ..... 292/94, 1, 166, 255, 292/347, 336.3, DIG. 15, DIG. 25, 174

[56] References Cited

U.S. PATENT DOCUMENTS

| | | | |
|---|---|---|---|
| 283,770 | 8/1883 | Geiger . | |
| 584,588 | 6/1897 | Headland . | |
| 831,584 | 9/1906 | Vincent . | |
| 918,730 | 4/1909 | Bronson . | |
| 1,084,830 | 1/1914 | Tate et al. | 292/255 |
| 1,172,205 | 2/1916 | Gillentine . | |
| 1,552,462 | 9/1925 | Bailey | 292/255 |
| 1,583,818 | 5/1926 | White . | |
| 2,741,504 | 4/1956 | Dale | 292/255 |
| 3,575,453 | 4/1971 | Hohl | 292/336.3 |
| 4,504,087 | 3/1985 | Pennington | 292/336.3 X |

FOREIGN PATENT DOCUMENTS

| | | |
|---|---|---|
| 152910 | 10/1920 | United Kingdom . |

*Primary Examiner*—Richard E. Moore

*Attorney, Agent, or Firm*—Lowell H. McCarter

[57] ABSTRACT

The portable door opening device comprises an elongated tubular member having an integral hook like means above the center of the tubular member. At the lower end of the tubular member is positioned a foot pedal member when operated by foot pressure in a down vertical motion causes a clamping collar or door knob grip to rotate and releases a conventional door latch mechanism.

14 Claims, 4 Drawing Figures

PORTABLE FOOT OPERATED DOOR OPENER

BACKGROUND OF INVENTION

The present invention relates to a portable foot operated door opening device that is portable and easily moved from one door to another or from one side of the door to the other. The device of this invention has no permanent parts affixed to the door.

The device provides a novel foot operated means for operating door latches to permit easy opening of the door, such as by a person whose hands are occupied with the carrying of bundles or the like. This device will have particular applicability for doors in homes occupied by the elderly or those infirmed with illnesses which prevent them from using their hands and arms for opening a door latched with conventional door knobs. The device is so designed and constructed such that it can be used to open a door that swings out or swings in because of its unique construction. Foot operated door openers, as the prior art patents show, go back at least one hundred years. U.S. Pat. No. 283,770 and U.S. Pat. No. 584,588 illustrate foot powered door openers with permanent attachments to the door latch mechanism.

In the early 1900's, U.S. Pat. Nos. 831,584; 918,730; 1,084,830; and 1,172,205 illustrate other door opening devices requiring a permanent attachment to the door in order to operate. As late as 1956 in U.S. Pat. No. 2,741,504 attempts have been made to provide remote control door knob operating means for various purposes.

BRIEF SUMMARY OF THE INVENTION

The present portable door opening device comprises an elongated tubular member provided with an integral hook means positioned above the middle of the tubular members. The hook can be a rigid member at an angle of between 30 to 60 degrees to the tubular member. An alternative integral hook means can be a rigid upside L-shaped with the foot of the L in a horizontal plane to form a U-shaped hook means with the tubular member forming one leg of the upside down U. The hook sets on the door knob shaft to hold the door opener on and against the door. The device further includes a foot pedal member slidingly affixed at the lower end of the tubular member for vertical movement such that the sliding member operates a clamping collar or door knob grip assembly that allows the individual to release the door latch by using a foot to activate the pedal member in a downward vertical movement.

BRIEF DESCRIPTION OF DRAWINGS

The present invention will now be described in conjunction with the accompanying specification and with the reference to the drawings in which like numerals are used to identify like elements as they may appear throughout the several drawing figures and in which.

DETAILED DESCRIPTION OF THE PREFERRED EMBODIMENT

Figure 1:
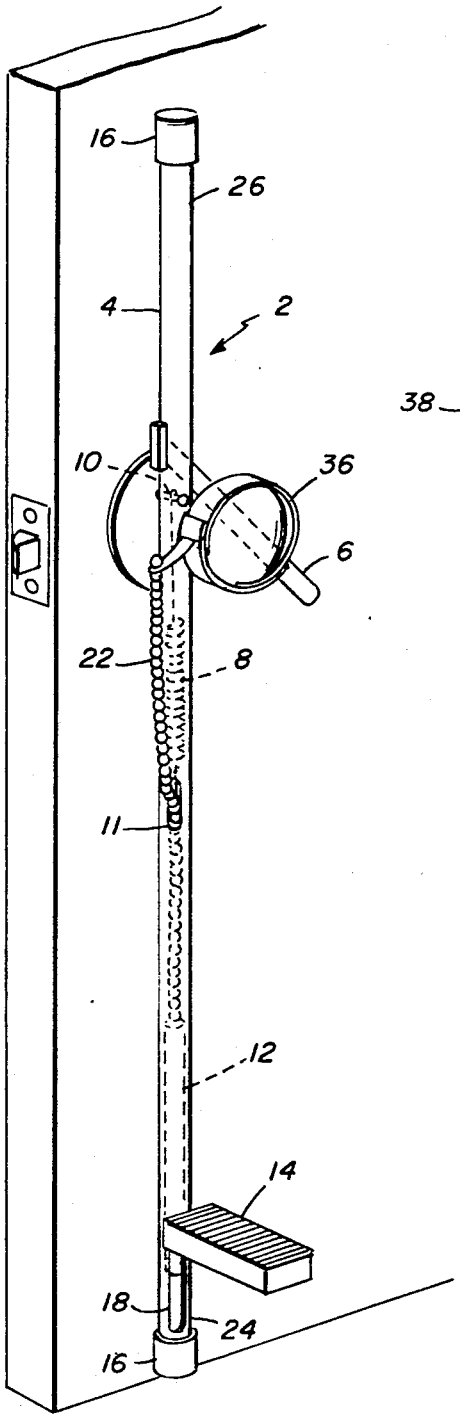
FIG. 1 is a perspective view of a portion of a door and of the portable foot powered door opening device removably mounted thereon.
Figure 4:
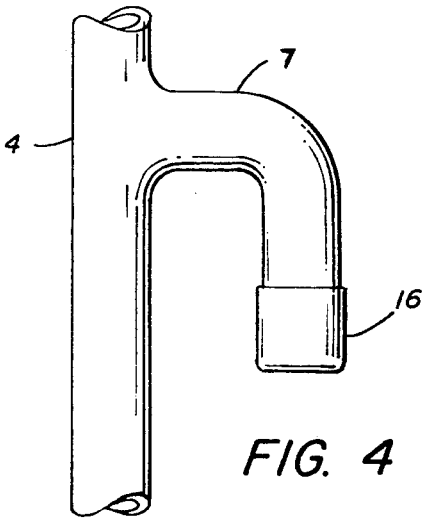
FIG. 4 is a view of an alternative form of hook member.

FIG. 1 shows a portion of a door where the door includes a conventional knob connected to the conventional latch mechanism. The portable foot powered door opening device, according to the present invention, is indicated generally by the numeral 2. An elongated hollow metal or plastic tubular member 4 rests against the surface of the door held in place by a hook like member 6. A portion, perhaps as much as a third of the tubular member 4 extends above the door knob shaft. The hook like member 6 is positioned at an angle between about 30 and 60 degrees from the vertical of the tubular member 4 such that the hook 6 will fit over a wide range of door knob shaft sizes. It should also be recognized that the hook like member 6 may also be formed in a curved linear manner to fit over the door knob shaft. Such an alternative embodiment is shown in FIG. 4. Interior to the tubular member 4 is an elastic member, preferably a coil spring 8, although rubber or other elastic materials may be used. A fastening means 10 such as a screw, rivet or bolt holds the upper end of the spring 8 or the elastic member in a fixed relationship with the tubular member 4. In the lower portion 24 of the tubular member, an opening or slot 18 is adapted to receive a foot pedal member 14.

At the upper 26 and lower 24 ends of the tubular members are end caps 16. The end caps 16 are preferably manufactured from a relatively soft pliable plastic material so that they are held frictional on the end 26, 24 of tubular member 4. The end caps 16 prevent the ends 26, 24 of the tubular member 4 from marring the surface of the door and provide a friction surface for bearing against the door. A similar end cap 16 can be used on the lower end of the alternate hook member 7 shown in FIG. 4.

Figure 3:
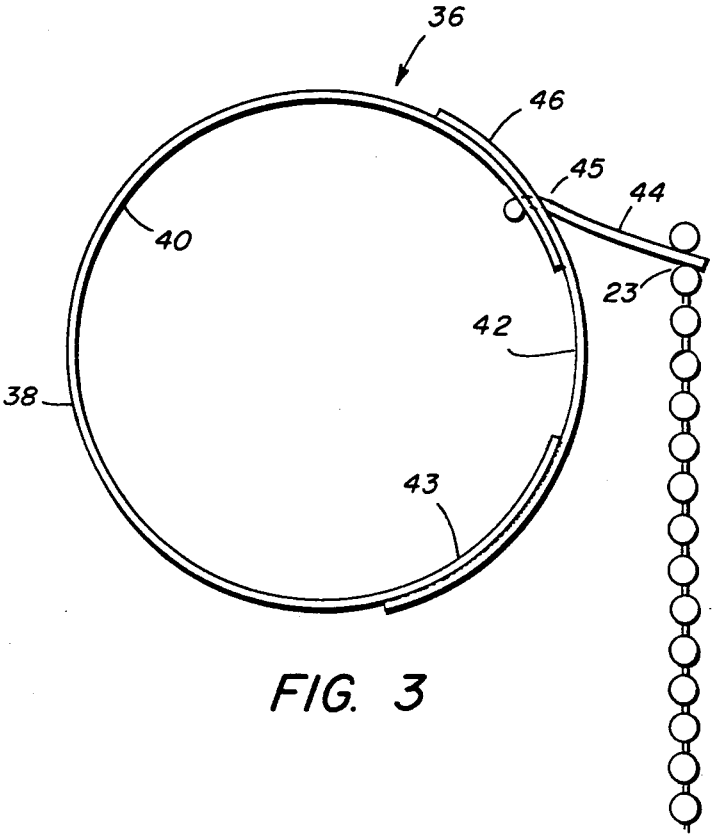
FIG. 3 is a view of the door knob grip assembly.
Figure 2:
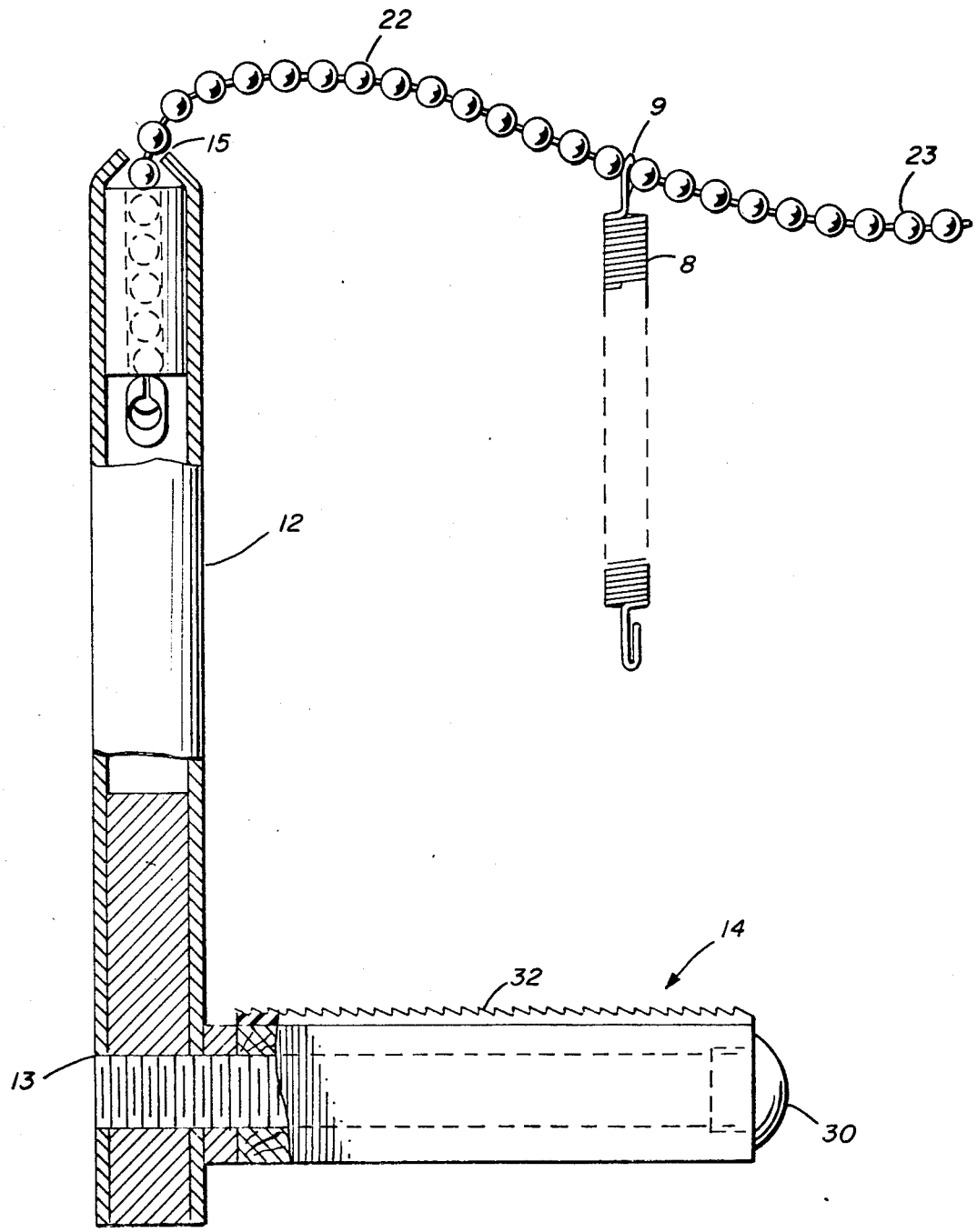
FIG. 2 is a side view of the slide tube and pedal assembly.

Referring now to FIGS. 2 and 3, the foot pedal mechanism includes a sliding member 12 having an outside diameter of such size to allow the sliding member to slide freely inside the lower end 24 of the tubular member 4. The foot pedal 14 is threadedly or permanently attached to the lower end 13 of the sliding member 12. Preferably, the foot pedal will have serrations 32 to assist in the operation of the door opener. A beaded chain or elongated, flexible member 22 is attached at one end 15 to the upper end of the sliding member 12. The return coil spring 8 is removably attached as at 9 intermediate the ends of the chain member 22. The upper end 23 of the chain 22 is removably attached to a door knob grip or clamping collar assembly 36 as shown in FIG. 3. Referring now to FIG. 3, the flexible band member or clamping collar assembly 36 is an adjustable strap-like member 38 preferably with a rubberized coating 40 or other surface 40 to assist in gripping the door knob. For example, a Velcro type strip could be permanently attached to the door knob such that a mating Velcro strip could be used as the mating strap member 38. In the embodiment shown here, a portion of the strap member 38 may be an elastic or rubber 42 to allow adaptability to door knobs of different sizes. In another embodiment, the entire strap 38 may be manufactured from an elasticized material that will provide a firm grip on the door knob. The ends of the strap member may be permanently fixed together or an adjusting means 46 such as Velcro type fastener may be used to provide adjustability in the size of the strap. Attached to the strap 38 adjacent the adjusting means 46 is a hook-like member 44 i.e. a bead chain hook to which the upper end 23 of the chain or elongated member 22 is removably attached.

In the FIG. 4 embodiment a broken away portion of the elongated tubular member 4 is shown with an alternative hook like member 7 for holding the portable door opener on the door knob shaft. For example, it is contemplated that the elongated tubular member 4 can be made from a rigid plastic material by molding the tubular member 4 and hook like member integrally in two parts. The sliding tube 12 foot pedal assembly along with the coil spring 8 and beaded chain 22 would be assembled in one part of the integrally molded tubular-hook member and the second molded tubular-hook member part fitted thereto and mechanically or resistance welded to form an integral hook member 7 elongated tubular member 4. An end cap 16 as described above may be placed on the lower end of the hook member 7.

In a preferred embodiment the tubular member 4 will be between about forty and forty eight inches long with from about four to ten or more inches of the tubular member 4 extending above the hook member 6. The tubular member 4 will not extend below the bottom edge of the door such that the lower end 24 does not catch on or cause wear of the floor surface covering whether it be carpet or a hard floor surface covering. The tubular member typically should have an inside diameter of greater than about one-half inch. An elongated opening 11 through which the beaded chain 22 travels is positioned between about twenty two to twenty five inches above the lower end 24 of the tubular member. Depending upon the particular construction, an elongated slot 18 having approximate dimensions of about one quarter inch in width and three and one half inches in length is positioned on the outside of the lower end 24 of the tubular member 4. The sliding member assembly, FIG. 2, has a slide tube 12 of about five to ten inches in length with an outside diameter not to exceed that which will slide without undue friction inside the lower end 24 of tubular member 4. Preferably the outside diameter of the slide tube will be about one half inch or less. The upper end 15 of slide tube 12 is crimped to accommodate ease of assembly and provide a means of removably attaching the lower end of bead chain 22. The foot pedal 14 preferably has dimensions of about four inches in length and at least two inches in width to provide a sufficiently wide friction bearing surface to accommodate the foot of the person using the door opener. The foot pedal 14 is fastened to the slide member 12 between one-half and one inch above the lower end of the slide tube 12. A carriage bolt 30 may be used to secure foot pedal to slide tube 12. The bead chain 22 preferably will have beads of about one eighth inch diameter in size and be twenty or more inches long. The coiled return spring 8, removably attached near the lower end of the beaded chain 22, may be for example about ten inches long and of a strength sufficient to lift foot pedal 14 and sliding member 12 from its lower position when the foot is removed.

The clamping collar assembly 36 as shown in FIG. 3 may be made of a single piece of elastic material or two or more pieces of compatible materials. In the embodiment described here, the width of the clamping collar assembly 36 preferably is about three quarters to one inch wide and comprises a nylon or the like material strap 38 with a rubberized coating 40 about three and one half to four inches long. Adhesively fastened or sewn to the strap 38 is an elastic or rubber material 42 of the same width and about three to three and one half inches long fastened with an overlap 43 of at least one inch or more. Slots 45 are provided in the free ends of the elastic or rubber material 42 and nylon strap 38 to accommodate the bead chain hook 44 and to hold the collar on the door knob. The bead chain hook 44 is constructed from semi-stiff fifty thousandths diameter steel wire and one end is adapted to fit through the slots 45 to hold the clamping collar assembly 16 on the door knob. The other end of the bead chain hook 44 is formed to hold the upper end 23 of the bead chain in an operational relationship with the foot pedal 14 as shown in FIG. 1.

Having described the components of the foot powered door opener, I will now describe its operation. The door opener is placed over the door knob shaft with the hook-member 6 resting on the shaft. The clamping collar assembly 36 is adjusted and placed snuggly around the door knob positioning the chain 22 such that with a downward pull the door knob will turn thus releasing the latch mechanism. It should be noted that the portable foot operated door opener will work on doors where the latch mechanism is released with either a clockwise or counter clockwise movement. Once the door knob grip assembly 36 is in place, the portable foot powered door opener is ready to use. The operator pushes downwardly on the foot pedal 14 sliding the foot pedal mechanism in slot 18 causing a downward clockwise or counter clockwise movement of the door knob grip assembly 36 such that the door knob is turned releasing the latch. In the outwardly opening door mode the friction of the operator's foot on the serrated or roughened surface 32 of the foot pedal 14 allows the user to push the door open with the foot while holding the slide member 12 in its lower position such that the door latching mechanism remains in the open position. The lower end 24 tubular member 4, having the protective end cap 16 allows the operator to push against the door without marring or scratching the doors surface. If the door opens inwardly, the serrated surface 32 on the foot pedal 14 allows the operator to pull the door toward you. In the inwardly opening mode the operator will be pulling the door toward themselves such that the lower end 24 of tubular member 4 tends to pull away from the door surface. The door opener hangs on the door knob shaft and has an upper end 26 extending a reasonable length above the hook member 6. The hook member 6 on the door knob shaft provides a fulcrum point such that, when the lower end 24 is being pulled away from the door surface the upper end 26 with its protective end cap 16 will be pushing against the door surface permitting the operator to easily open the door toward themselves without the use of their hands.

It is important with respect to the present invention that the device is light, compact and easily installable where desired. This makes it useful to travelers as wells as people using it in their own personal residence.

It will, thus, be seen that I have provided by my invention a foot operated portable door opening device which combines and performs the door opening function for a door opening into or out of a room in a simple, straight forward and reliable manner and with a novel arrangement of parts unknown to the prior art.

What I claim is:

1. A portable foot operated door opener comprising (a) an elongated tubular member having upper and lower ends;

(b) hook means integral to the tubular member positioned between the upper and lower ends, the hook means and the tubular member forming a means adapted to fit over the spindle of a door knob shaft to hold the tubular member on the door;

(c) a pedal member slidingly affixed for vertical movement in the lower end of the tubular member;

(d) flexible band member for engaging a door knob flexibly coupled to the pedal member;

(e) resilient means interior to the tubular member a portion of which extends through an opening in the tubular member below the hooks means, the resilient means having an upper end fixed to the tubular member and a lower end of the resilient means fixed to the pedal member such that when the flexible band member, linked to the pedal member by way of the resilient means, is in an engaging relationship with a door knob a downward force on the pedal member causes the door knob to rotate and disengage the door latch.

2. The portable foot operated door opener of claim 1 wherein the resilient means is a coil spring.

3. The portable foot operated door opener of claim 2 wherein the hook member is at an angle of between 30 to 60 degrees to the tubular member.

4. The opener of claim 1 wherein the hook means is in the upper one-quarter of the tubular member.

5. The opener of claim 1 wherein the pedal member slides in an elongated slot in the lower end of the tubular member.

6. The opener of claim 1 wherein the flexible band member is coated with a rubberized material to grip a door knob surface.

7. The opener of claim 1 wherein the upper and lower ends of the tubular member and the hook means have protective cap end members thereon.

8. In combination with a door having a conventional door knob latching mechanism including a door knob and a door knob shaft, a foot powered portable opening device comprising (a) a hollow tubular member having an upper end positioned above the door knob shaft and a lower end having an elongated slot therein positioned adjacent the bottom of the door, the tubular member having an opening near the middle of the length thereof;

(b) a hook like member integral with and in the upper third of the tubular member and adapted to fit over the door knob shaft to hold the tubular member against the surface of the door;

(c) a sliding foot pedal assembly adapted for vertical movement in the elongated slot in the lower end of the tubular member;

(d) a door knob collar clamping assembly on the door knob;

(e) a coil spring interior to the tubular member having the upper end affixed to the tubular member adjacent the hook like member;

(f) a chain extending through the opening near the middle of the tubular member, collar clamping assembly fastened to the upper end of the chain, the lower end of the coil spring fastened between the ends of the chain, and sliding foot pedal assembly fastened to the lower end of chain such that when the foot pedal assembly is moved in a vertically downward movement the chain pulls down on the door knob collar clamping assembly rotating the door knob releasing the latching mechanism and upon release the foot pedal assembly is returned to its original position by the action of the coil spring.

9. The combination of claim 8 wherein the chain is a beaded chain.

10. A portable foot operated door opener comprising (a) an elongated tubular member having an upper and lower end with an opening therebetween and an elongated slot in the lower end;

(b) a hook member integral with tubular member and positioned in the upper third of the tubular member;

(c) a coil spring interior to the tubular member having an upper end secured to the tubular member adjacent the hook member;

(d) a beaded chain positioned in the opening and having the lower end of the coil spring removably attached between upper and lower ends of the beaded chain;

(e) a clamping collar assembly adapted to receive and grip a door knob, the collar assembly removably fastened to the upper end of the beaded chain; and (f) a foot pedal assembly positioned for vertical sliding movement in the elongated slot in the lower end of the tubular member, the lower end of the beaded chain affixed to the foot pedal assembly.

11. The opener of claim 10 wherein the foot pedal assembly comprises a vertical elongated tube slidingly positioned interior to the tubular member and a horizontally extending member exterior to the tubular member.

12. The opener of claim 11 wherein the lower end of the beaded chain is fastened to an upper end of the vertical elongated tube.

13. The opener of claim 10 wherein the collar clamping assembly comprises an elasticized material having a rubberized coating adapted to grip a door knob surface and a bead chain hook member for removably attaching the beaded chain.

14. The opener of claim 10 wherein protective end cap members are on the upper and lower ends of the elongated tubular member.

* * * * *